US005310018A

United States Patent [19]

Lahaie

[11] Patent Number: 5,310,018

[45] Date of Patent: May 10, 1994

[54] SCAFFOLD

[76] Inventor: Jean J. Lahaie, Apt. 328 1421 Brookdale, Cornwall, Ontario K6J 5E8, Canada

[21] Appl. No.: 992,162

[22] Filed: Dec. 17, 1992

[51] Int. Cl.[5] ..... E04B 1/20

[52] U.S. Cl. ..... 182/141; 182/63; 182/113; 182/148

[58] Field of Search ..... 182/148, 145, 63, 113, 182/141

[56] References Cited

U.S. PATENT DOCUMENTS

| | | | |
|---|---|---|---|
| 1,085,207 | 1/1914 | Irby . | |
| 1,095,391 | 5/1914 | Fogle | 182/63 X |
| 1,332,011 | 2/1920 | Weinberg | 182/141 X |
| 2,753,224 | 7/1956 | Truche et al. | 182/113 |
| 2,948,363 | 8/1960 | Hopefeld | 182/63 X |
| 4,294,332 | 10/1981 | Ready . | |
| 4,967,733 | 11/1990 | Rousseau | 182/63 |
| 5,102,179 | 4/1992 | Royer . | |

*Primary Examiner*—Alvin C. Chin-Shue

[57] ABSTRACT

An improved scaffold of the lift type having a base and a working platform on top of the base. Vertical support posts are provided at the corners of the base passing through guide means at the corners of the platform. Cooperating drive means on the platform and posts are used to raise or lower the platform on the posts relative to the base. A motor on the platform selectively operates the drive means.

1 Claim, 4 Drawing Sheets

SCAFFOLD

BACKGROUND OF THE INVENTION

1. FIELD OF THE INVENTION

This invention is directed toward an improved scaffold.

The invention is more particularly directed toward an improved scaffold of the type having a lift platform.

2. DESCRIPTION OF THE PRIOR ART

There is a need, particularly by construction contractors of all trades, for a relatively small, inexpensive, lift scaffold in the work place. When repairs, maintenance or installations are needed in factories or warehouses at low heights it is common to employ ladders, or regular scaffolds having plank platforms. However it is difficult and/or awkward to carry or raise the repair, maintenance or installation equipment and/or needed parts on ladders or scaffolds. It is known also to use hydraulic lifts to raise a working platform. These hydraulic lifts are usually mobile, compact, and efficient but they are very expensive to purchase.

SUMMARY OF THE INVENTION

It is the purpose of the present invention to provide a small, portable scaffold, having a lift platform, that is quite inexpensive compared to known hydraulic lifts.

It is another purpose of the present invention to provide a scaffold having a lift platform that can be easily and compactly stored when not needed, and easily set up and operated when needed.

It is a further purpose of the present invention to provide a small, portable scaffold that is quite stable in the elevated position while working at low heights.

In accordance with the present invention the improved scaffold has a base with a platform on top of the base. Vertical support posts extend up from the base and the platform is guided on the support posts. Post extension sections are provided to lengthen the support posts as needed. Cooperating drive means on the support posts and platform are used to raise or lower the platform on the posts relative to the base. The cooperating drive means preferably comprise a rack and pinion system operated by a motor on the platform.

Scaffolds with lift platforms having extendable posts and employing a rack and pinion system to lift the platform on the posts are known as shown in U.S. Pat. Nos. 4,294,332 and 5,102,179 by way of example. However these known scaffolds are often large and cumbersome to set up and to store as exemplified by the scaffold in U.S. Pat. No. 4,294,332. In addition, these known large scaffolds often employ planks in the platform which can become lost when the scaffold is stored. When the known scaffolds are compact and relatively easy to set up, as exemplified by U.S. Pat. No. 5,102,179, they are quite unstable because they do not have a stable base. Scaffolds without a stable base require stabilizing means such as cables.

The scaffold of the present invention is quite compact and stores in a small space when not needed. The working platform forms an integral part of the scaffold and does not become lost when the scaffold is stored. The post extension sections are also safely stored. The scaffold can be stored on its side, taking up little space. The scaffold is provided with a base forming a stable foundation for the platform when it is raised. The use of a base eliminates or at least minimizes the need for stabilizing means.

The scaffold of the present invention is provided with movable casters allowing it to be easily removed from storage where it is stored on its side and wheeled to where it is needed. At the work site, two workers can easily turn the scaffold on its bottom, and reposition the casters if needed. The post extension sections are removed from storage in the base of the scaffold and set out on the platform. A worker on the platform interconnects a first set of post extension sections to the vertical support posts on the base and, operating a motor to run the drive means, raises the platform from the vertical support posts onto the post extension sections to elevate the platform.

A protective guard rail is provided about the platform. The platform, in addition to a plurality of post extension sections, also carries the tools and equipment needed by the worker on the platform. The worker adds post extension sections as needed, to lengthen the support posts. It is not contemplated that the platform is raised very high. The greatest height for a platform six to eight feet square would be about thirty feet. The platform is stable at this low height. If a larger platform were used, it could be raised to a greater height.

The invention is particularly directed toward a scaffold having, in its working position, a base and a working platform on top of the base. Vertical support posts are provided at the corners of the base. Guide means are provided at the corners of the working platform for the support posts. The scaffold has cooperating drive means on the platform and posts for use in raising or lowering the platform on the posts relative to the base. The drive means also support the platform on the posts. Motor means are provided on the platform, selectively operable to operate the drive means to raise or lower the platform.

DESCRIPTION OF THE PREFERRED EMBODIMENTS

Figure 1:
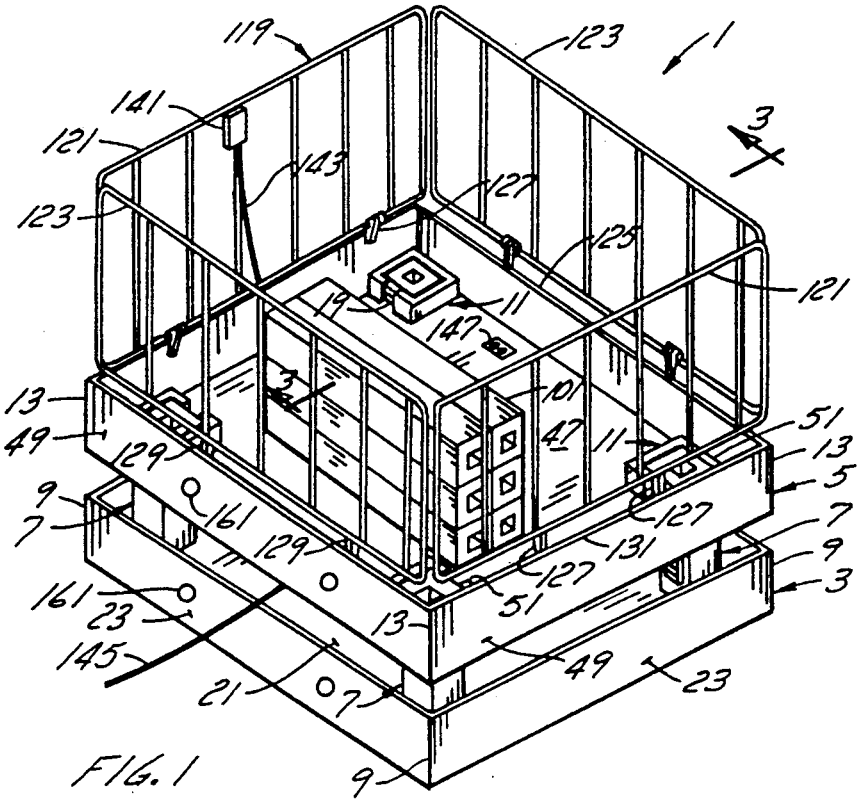
FIG. 1 is a perspective view of the scaffold in a lower working position.
Figure 3:
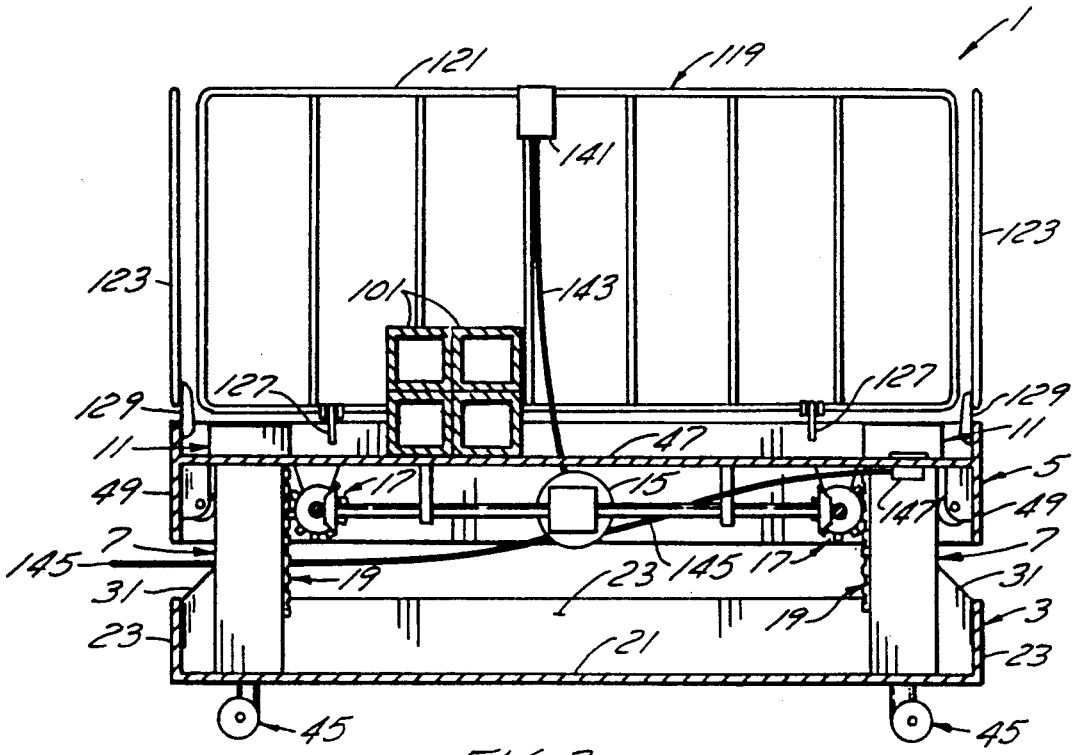
FIG. 3 is a cross-section view of the scaffold taking along line 3—3 in FIG. 1.
Figure 2:
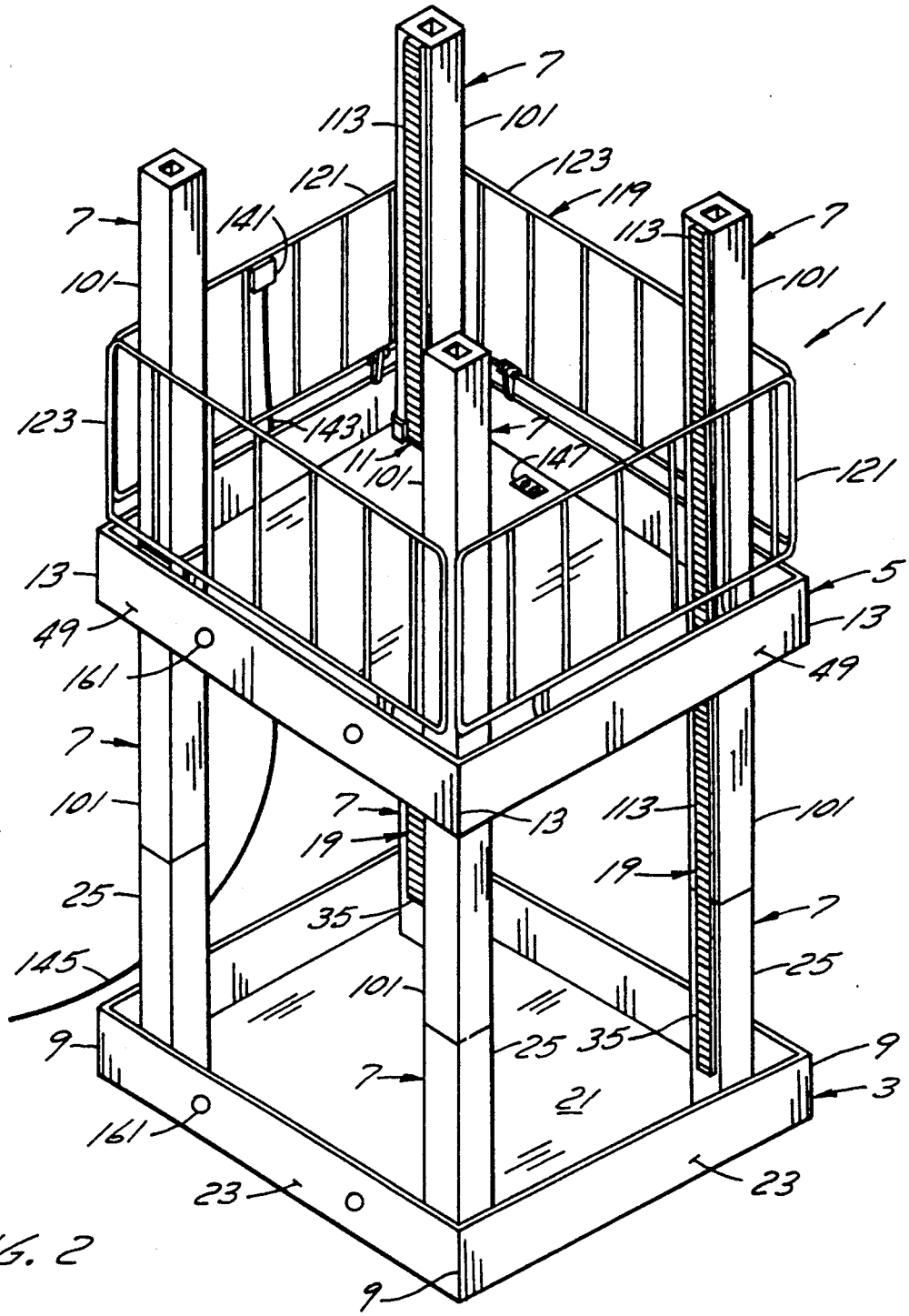
FIG. 2 is a perspective view of the scaffold in an upper working position.

The portable scaffold 1 of the present invention, as shown in its working position in FIGS. 1 to 3, has a base 3 and a working platform 5 above the base 3. The scaffold 1, also has vertical support posts 7, preferably one at each corner 9 of the base 3. Guide means 11 are provided at each corner 13 of the platform 5 through which the support posts 7 pass. The platform 5 carries a motor 15, as shown in FIG. 3. The scaffold 1 has cooperating drive means 17, 19 on the platform 5 and support posts 7 respectively to raise or lower the platform 5 on the posts 7 relative to the base 3. The motor 15 selectively operates the platform drive means 17 to raise or lower the platform 5.

Figure 5:
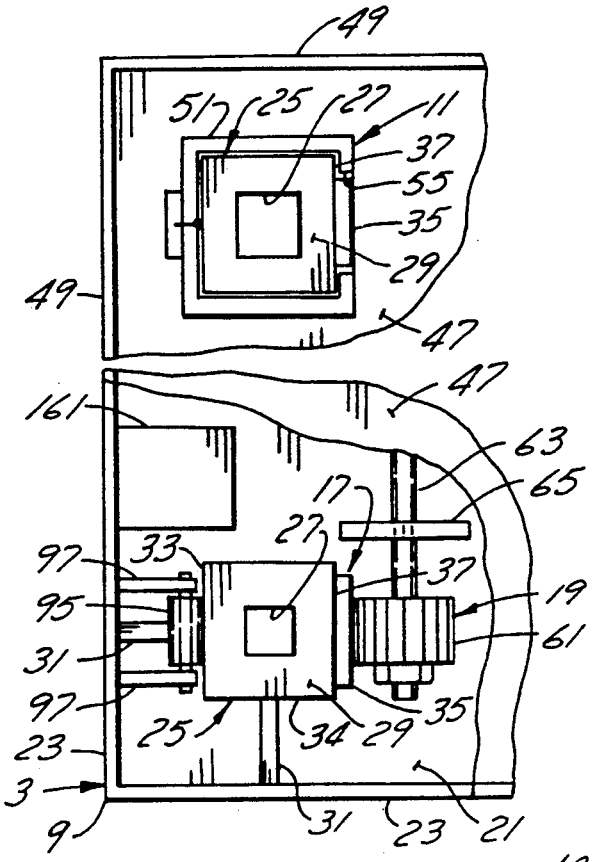
FIG. 5 is a detail top view of two corners of the base of the scaffold with a portion of the base floor removed at one of the corners.
Figure 4:
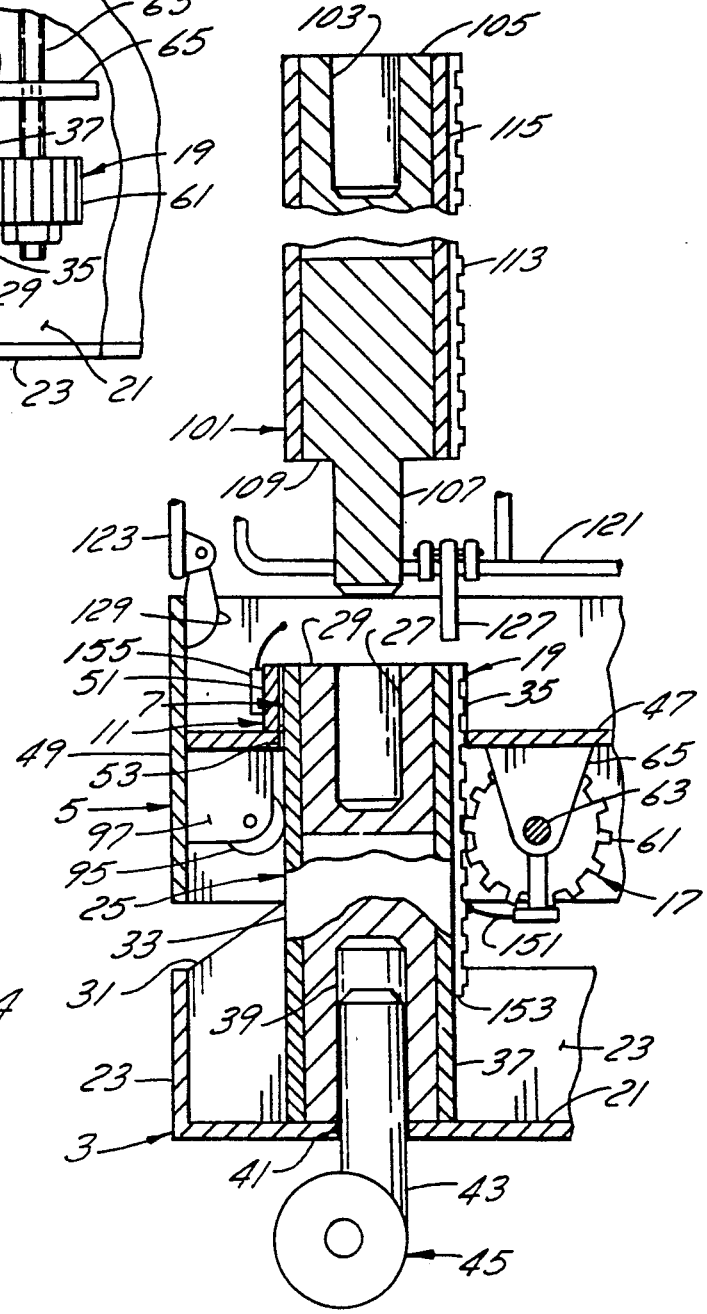
FIG. 4 is a detail elevation view of one corner of the base of the scaffold.

In more detail, the base 3 has a floor 21, preferably square in shape, with relatively low side walls 23 at the outer edge of the floor 21 that extend upwardly. Adjacent each corner 9 of the base 3, as shown in FIGS. 4 and 5, a short post base section 25 of a post 7 is fixed at its bottom to the floor 21. The post base section 25 preferably has a square cross-section and has a socket 27 in its top end 29. The socket 27 has a square cross-section. Braces 31 can connect between the sides 33, 34 of the post base section 25 adjacent the corner 9 and the side walls 23 to firmly anchor the post base section 25. A vertical rack section 35 is provided on one inner side 37 of the post base section, centrally located thereon. The rack section 35 is securely fixed to the post base section 25 and forms part of the cooperating drive means 19.

An opening 39 is provided in the bottom of post base section 25 in each corner, aligned with an opening 41 in the floor 21. The opening 39 receives the mounting post 43 of a caster 45. The casters 45 permit the scaffold 1 to be easily moved about in its working position.

The platform 5, as shown in FIGS. 1 to 3, also has a floor 47 and low side walls 49 about its outer edge that extend both upwardly and downwardly from the floor. Guide means 11 in the form of a short square sleeve 51 as shown in FIGS. 4 and 5 is provided on the platform floor 47 adjacent each corner 13. These guide sleeves 51 are aligned with the post base sections 25 on the base 3. The post base sections 25 extend through openings 53 in the floor 47 and through the sleeves 51. Each sleeve 51 has a slot 55 on an inner side for accommodating the rack section 35 on the post base section 25.

Figure 6:
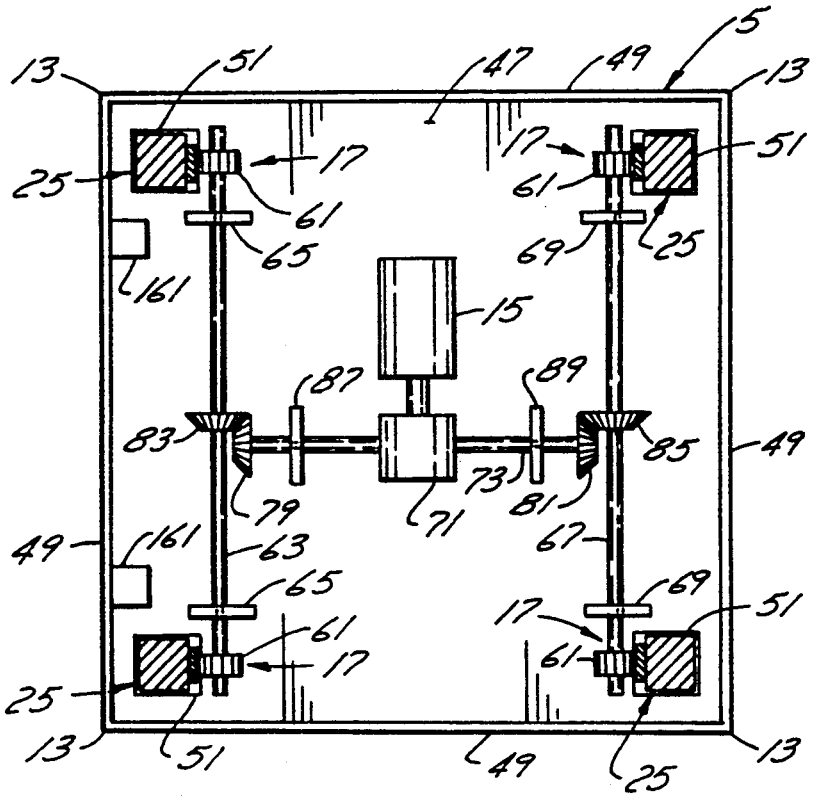
FIG. 6 is a bottom view of the platform of the scaffold.

The drive means 17 on the platform 5, as shown in FIG. 6, includes a pinion gear 61 adjacent each opening 51 under the floor 47. Two pinion gears 61 on one side of the platform are mounted on the ends of a first drive shaft 63 adjacent the inner side of the two openings 51 on the one side. The first drive shaft 63 is mounted via brackets 65 to the bottom of floor 47. The two pinion gears 61 on the opposite side of the platform are mounted on the ends of a second drive shaft 67, that is parallel to the first drive shaft 63, and is adjacent the inner side of the other two openings 51 on this other side. The second drive shaft 67 is also mounted via brackets 69 to the bottom of the floor 47. The motor 15 is mounted centrally under the floor 47. The output of the motor 15 is connected via a gear box 71 to a main drive shaft 73. The ends of main drive shaft 73, which extend transversely to the first and second drive shafts 63, 67, are connected via bevel gears 79, 81 to bevel gears 83, 85 fixed on the first and second drive shafts 63, 67. The main drive shaft 73 is mounted via brackets 87, 89 to the bottom of the floor 47. Operation of motor 15 will rotate the pinion gears 61 via the drive shafts 63, 67, 73 and the bevel gears.

A guide roller 95 is mounted on the underside of the floor 47 of the platform at each corner 13 via brackets 97 as shown in FIGS. 4 and 5. The guide roller 95 at each corner is adjacent the outer side of the opening 51 at that corner, opposite the pinion gear 61 at that corner.

The platform 5 carries a plurality of support post extension sections 101 as shown in FIGS. 1 to 3. Preferably, the extension sections 101 are short enough to fit on the floor 47 of the platform 5. Each extension section 101 has a square cross-section, a socket 103 at one end 105 and a connecting pin 107 at the other end 109 as shown in FIG. 4. The extension sections 101 are preferably tubular to decrease their weight. The sockets 103 are dimensioned to snugly receive the connecting pins 107 on other post extension sections 101. Each extension section 101 has a rack section 113 extending the length of one inner side 115 and centrally located thereon. The rack sections 113 are securely fixed to the extension section 101 and form part of the drive means 19.

A guard rail 119, made up of guard rail sections 121, 123, is provided about the top edge 125 of the sidewall 49 of the platform 5. The guard rail sections 121, 123 are pivotally mounted to brackets 127, 129 respectively on the sidewall 49. The brackets 127 on two opposed sides 131 of the sidewall 49 are slightly higher than the brackets 129 on the other two opposed sides 133 of the sidewall. This allows the guard rail sections 121 of the scaffold to fold over the folded guard rail sections 123 in the storage position of the scaffold. In the erected position, the guard rail sections 121, 123 are joined together by suitable means (not shown) to maintain them in the erected position about the floor of the platform.

The motor 15 is electric. An on-off switch operates the motor. The switch can be mounted in a control pad 141 that is connected to the motor by a flexible cable 143 as shown in FIGS. 1 to 3. The pad 141 can clip onto the guard rail 119. An extension cord 145 connects the motor 15 to a source of electrical power. The extension cord 145 can also supply power to a receptacle 147 in the floor 47 of the platform 5 so that the worker on the platform can use his tools. A reverse switch on the pad 141 allows the motor 15 to operate in either direction. Limit switches are provided on the platform 5 to stop the motor. A lower limit switch 151 as shown in FIG. 4 is mounted on the bottom of the platform 5. The limit switch 151 stops the motor 155 when it reaches the bottom end 153 of the rack section 35 on one of the post base sections 25. The lower limit switch 151 is located below the pinion gears 61 so that the gears 61 do not run off the rack sections 35. An upper limit switch 155 is mounted on the sleeve 51 mounted on the floor 47 of the platform 5. The upper limit switch 155 stops the motor 15 when it does not sense another post extension section 101. This prevents the platform from running off the posts 7. If desired an upper and lower limit switch arrangement could be provided at each post location.

Figure 7:
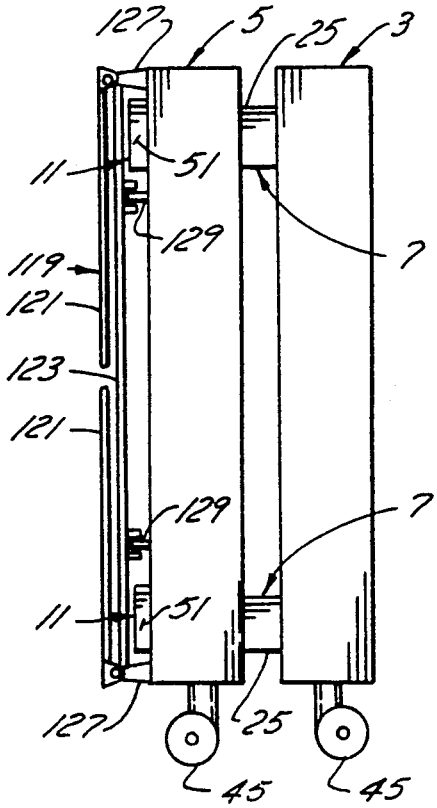
FIG. 7 is an elevation view of the scaffold in its stored position.

The scaffold 1 is stored on its side so as to take up less space when not being used, as shown in FIG. 7. In the storage position of the scaffold 1, the post base sections 25 of the posts 7 extend up through the sleeves 51 and guide openings 53 in the platform 5. The platform 5 is closely adjacent the base 3 and the pinion gears 61 mesh with the rack sections 35 on the post base sections 25 near their lower ends 153. The guard rail 119 is folded down onto the platform 5 and the post extension sections 101 are stored on the base 3 within the base side walls 23 under the platform 5. Suitable means, such as straps, (not shown) can be provided to prevent the extension sections 101 from shifting when the scaffold 1 is moved onto its side in the storage position.

Mounting blocks 161 are provided in one side wall 23 of the base 3 and one side wall 49 of the platform 5 as shown in FIGS. 1 and 5 for receiving the casters 45. The casters 45 can be removed from the base sections 25 and inserted in the mounting blocks 161 so that the scaffold can be easily moved while on its side when in its storage position.

In use, the scaffold 1 is wheeled out on its side on the casters 45 from storage to where it will be used. The casters 45 are removed from the side of the scaffold at the place of use, the scaffold is tipped onto its base from its side, and the casters 45 are placed under the base 3. The guard rail 119 is raised and the motor 15 is plugged in. The motor 15 is operated to slightly raise the platform 5 on the post base sections 25 via rotation of the pinon gears 61, allowing access to the post extension sections 101 stored in the base 3. The extension sections 101 are removed and placed on the platform 5. The worker stands on the platform 5 and places one extension section 101 on each post base section 25, via the pin and socket connection ensuring that the rack section 113 on each extension section 101 forms an unbroken extension of the rack section 35 on each post base section 25. The operator again operates the motor 15 to rotate the pinion gears 61 which travel smoothly from rack sections 35 to rack sections 113 raising the platform 5 on the posts 7 above the base 3. The base 3 provides a solid, secure foundation for the posts 7 and the platform 5 carried on the posts. To go higher, another set of four post extension sections 101 is placed on top of the first four post extension sections 101. When the working height is reached the motor 15 is stopped and the platform 5 is rigidly supported at this height by the pinion gears 61 meshing with the rack sections 113. As the platform 5 is lowered, each uppermost set of four extension sections 101, that the platform has passed by, is removed from the next set of extension sections and stored on the platform.

I claim:

1. A scaffold having in its working position: a base; a working platform on top of the base; vertical support posts at the corners of the base, each post comprising a relatively short post base section fixed to a corner of the base; a plurality of relatively long, post extension sections; interconnecting means on the free end of the post base section, and on the ends of the post extension sections, to rigidly interconnect one or more of the post extension sections to each post base section and to each other to extend the support posts; guide means at the corners of the working platform for the support posts, the guide means comprising a short guide sleeve fixed on the platform and aligned with a hole on the platform through which the support post passes; cooperating drive means on the platform and posts for use in raising or lowering the platform on the posts relative to the base, the drive means also supporting the platform on the posts; motor means on the platform, the motor means selectively operable to operate the drive means to raise or lower the platform; casters for the scaffold; means in the bottom of the base, at the corners, for removably receiving the casters; means in one side of the scaffold for removably receiving the casters; the casters adapted to be mounted in the bottom of the base when the scaffold is being used, and in the side of the scaffold when the scaffold is being stored.

* * * * *